US006155917A

United States Patent [19]

Tasikas

[11] Patent Number: 6,155,917

[45] Date of Patent: Dec. 5, 2000

[54] BELT SANDER WITH CONTROL BAR

[76] Inventor: James Tasikas, 84 Northline Rd., Toronto, Ontario, Canada, M4B 3E5

[21] Appl. No.: 09/294,674

[22] Filed: Apr. 19, 1999

[51] Int. Cl.[7] ..... B24B 23/00

[52] U.S. Cl. ..... 451/355; 451/350

[58] Field of Search ..... 451/355, 350, 451/296, 303, 311

[56] References Cited

U.S. PATENT DOCUMENTS

| | | | |
|---|---|---|---|
| 3,312,116 | 4/1967 | Blevins | 451/355 |
| 3,789,552 | 2/1974 | Bradbury et al. | 451/355 |
| 4,118,897 | 10/1978 | Martin | 451/355 |
| 5,224,301 | 7/1993 | Tasikas | 451/355 |
| 5,341,605 | 8/1994 | Tasikas . | |
| 5,403,229 | 4/1995 | Seli | 451/355 |

*Primary Examiner*—Eileen P. Morgan

[57] ABSTRACT

A belt sander for sanding a work piece with a sanding belt and having, a housing, a main roll mounted in the housing and a motor for rotating the main roll, an extension roll located adjacent to the main roll for extending a sanding belt from the main roll substantially parallel to a plane of the work piece, and, a control bar located between the extension roll and the main roll for controlling the sanding belt and defining a contact area for the sanding belt.

7 Claims, 4 Drawing Sheets

BELT SANDER WITH CONTROL BAR

FIELD OF THE INVENTION

The invention relates to belt sanders, particularly to belt sanders for hardwood floors and to a control bar for holding an area of the abrasive element flat.

BACKGROUND OF THE INVENTION

Sanding of surfaces is usually carried out with one of two types of pieces of equipment. The simplest form of equipment is the so-called drum sander. This piece of equipment comprises a cylindrical drum, around which a strip of abrasive material is secured. A motor rotates the drum. The drum is moved around the work surface, (or the surface may be moved over the drum) and sands it smooth.

This type of equipment is reasonably economic to operate and is economical in its consumption of abrasive paper. However, the quality of surface finish is somewhat impaired. This is due to the gap at each end of the strip. It is also difficult to control since its area of contact between the paper and the surface is essentially a line contact, i.e. tangent to the drum.

Another form of equipment used is a so-called belt sander. In this type of equipment, a drum is provided, and adjacent the drum a tension roller is provided. The abrasive material consists of an endless belt of abrasive material. The belt is arranged around the drum and the tension roller. The drum is then rotated by a motor, thus causing the belt to abrade the work surface. This type of equipment produces a higher quality surface finish in use. However, even in this case the contact between the belt and the work surface is a line contact (i.e. a tangent to the drum) and this is difficult to control on some surfaces. Belt sanders are used frequently for the final or finish sanding of a hardwood floor surface, but have many other uses.

A disadvantage inherent in the use of both drum sanders and belt sanders is the fact that the point of contact between the sanding element, i.e. the sanding sheet or belt and the work surface, lies along a line contact defined by a tangent to the periphery of the main drum. Sanding is usually carried out because the surface to be sanded is initially uneven. It may, for example, define high spots and low spots. In addition, in the case of hardwood floors, for example, there are areas which are softer, where the grain is wider apart, and there are areas which are harder, where the grain is closer together.

In all these cases, the conventional drum sander or belt sander was liable to result in uneven surface finishes. In the hands of an inexperienced operator it could easily gouge the surface. Sanding of many products by drum or belt sanders had to carried out with great care and considerable skill and experience. In the past, for example, flooring installers and service person who use the sanders have usually been obliged to purchase both belt sanders and drum sanders. Both types of sanders provide only a line (or tangent) contact with the work surface. There are various disadvantages to this practice. In the first place, service persons such as the flooring installer must purchase two relatively expensive pieces of equipment. Secondly, the flooring installer or other service person must move both pieces of equipment from one job site to another, or alternatively, keep several sets of both types of equipment. When one piece of equipment becomes unservicable then it may be impossible to continue with the job even though the other piece of equipment is still in good condition. Thirdly there is the simple fact of cost to the flooring installer and also the fact that he must maintain a stock both of sheet sandpaper as well as sanding belts, so that each piece of equipment may be used as desired.

In the past, certain forms of belt sander have been available in which the belt was stretched between two rolls, along a more or less linear path. A work piece could be placed on the belt, and the belt would provide a sanding function over a rectangular area, where it contacted the belt.

However, these belt sanders which were commonly used in industrial and in wood working shops for sanding generally flat wood work pieces, themselves had certain disadvantages. In order to keep the belt central on the two rolls, the two rolls were formed with a somewhat convex profile, i.e. they were generally speaking of greater diameter in the centre and tapering down to a smaller diameter at each end. The purpose of this was to prevent the belt from wandering sideways across the rolls.

The end result of this process was that the effect of the belt sander tended to be somewhat uneven in that the belt was tighter in the centre than it was along the side. Consequently, the belt sander tended to sand in a somewhat uneven fashion.

It is desirable to provide a piece of equipment, which can be used for belt sanding with greater control of the surface contact. In this way, service persons such as flooring installers may buy one type only of equipment. There will then be substantial savings in operations, and service people will be able to provide their service in a more efficient and expeditious manner than with either type of sanding equipment described above, having only a line contact with the surface.

BRIEF SUMMARY OF THE INVENTION

With the view to overcoming these various disadvantages described in relation to prior art equipment, the invention comprises a belt sander and comprising, housing means, a main drum or roll mounted in said housing means and power operated means for rotating the same, an extension roll located adjacent to the main drum for extending a said belt from said drum substantially parallel to the plane of the work piece, and a belt control bar located between the extension roll and the main drum for controlling the belt and defining a planar contact area for the belt.

Preferably the invention further provides tension means operable whereby a belt of abrasive material placed around the main drum and extension roll and may be placed in tension, and access means in said housing means for giving access to said main drum and said extension roll.

The invention further comprises the provision of such a belt sander having a control bar which is located between the extension roll and the main drum, in which the extension roll and the main drum together define a generally planar length of the sanding belt, extending between them, which is intended to contact, at least in part, the surface to be treated, and in which the control bar causes this portion of the belt to extend downwardly slightly relative to a tangent between the main roll and the extension roll.

Preferably, the control bar is provided with an anti-friction surface typically, for example, an anti-friction plastic material.

The anti-friction plastic material will be of such a type that it can engage the rear surface of the sanding belt, and allow pressure to be applied against the belt, without any significant build up of heat due to friction between the back of the belt and the anti-friction plastic.

The invention further comprises such a belt sander and wherein said tension means includes a tension roller movably mounted relative to said main drum, and biassing means operable to urge said tension roller away from said main drum, whereby to apply tension to a belt placed therearound.

The invention further comprises such a belt sander wherein said tension roller further comprises pressure means operable on said tension roller, whereby to force said tension roller against said biassing means towards said main drum or roll, thereby permitting removal and replacement of said sanding belt thereon. The invention further comprises such a belt sander and including rotatable belt guide members mounted on said bracket means at either end thereof, adjacent opposite ends of said tension roller, whereby to guide said belt passing over said tension roller.

The invention further comprises such a belt sander and wherein said mounting arm member is pivotally mounted to said housing, and is both slidable towards and away from said main drum, and is further swingable, whereby to procure tilting of said mounting arm means and said tension roller relative to said main drum.

The various features of novelty which characterize the invention are pointed out with more particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

DESCRIPTION OF A SPECIFIC EMBODIMENT

Figure 1:
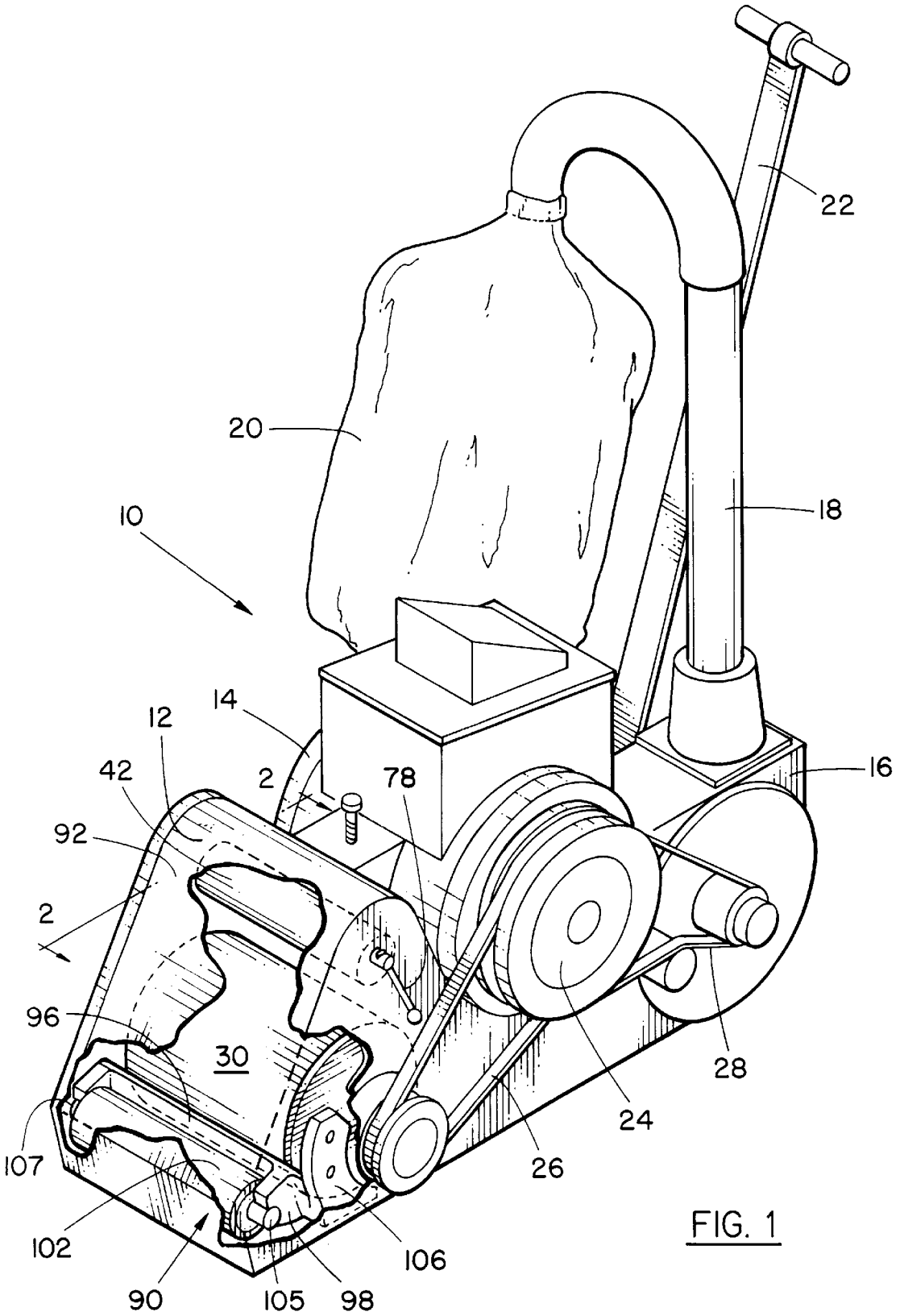
FIG. 1 is a perspective illustration showing a belt sander illustrating one embodiment of the invention.

Referring first of all to FIG. 1, it will be seen that the belt sander is there illustrated by the general reference arrow 10. In this embodiment the sander 10 is a floor sander. The invention is not limited to floor sanders but is of wider application to various work pieces and work surfaces, and to various types of surface treating operations.

The sander 10 will be seen to comprise a belt housing 12, a motor housing 14, and a vacuum housing 16. A vacuum hose 18 and bag 20 are typically provided, for collecting dust. The entire apparatus is controlled by means of a handle 22, and suitable on/off controls will be provided (not shown).

The motor (not shown) within housing 14 drives a two element pulley 24. Two belts 26 and 28 respectively drive the main roll (below) and the vacuum (not shown) in housing 16.

Figure 2:
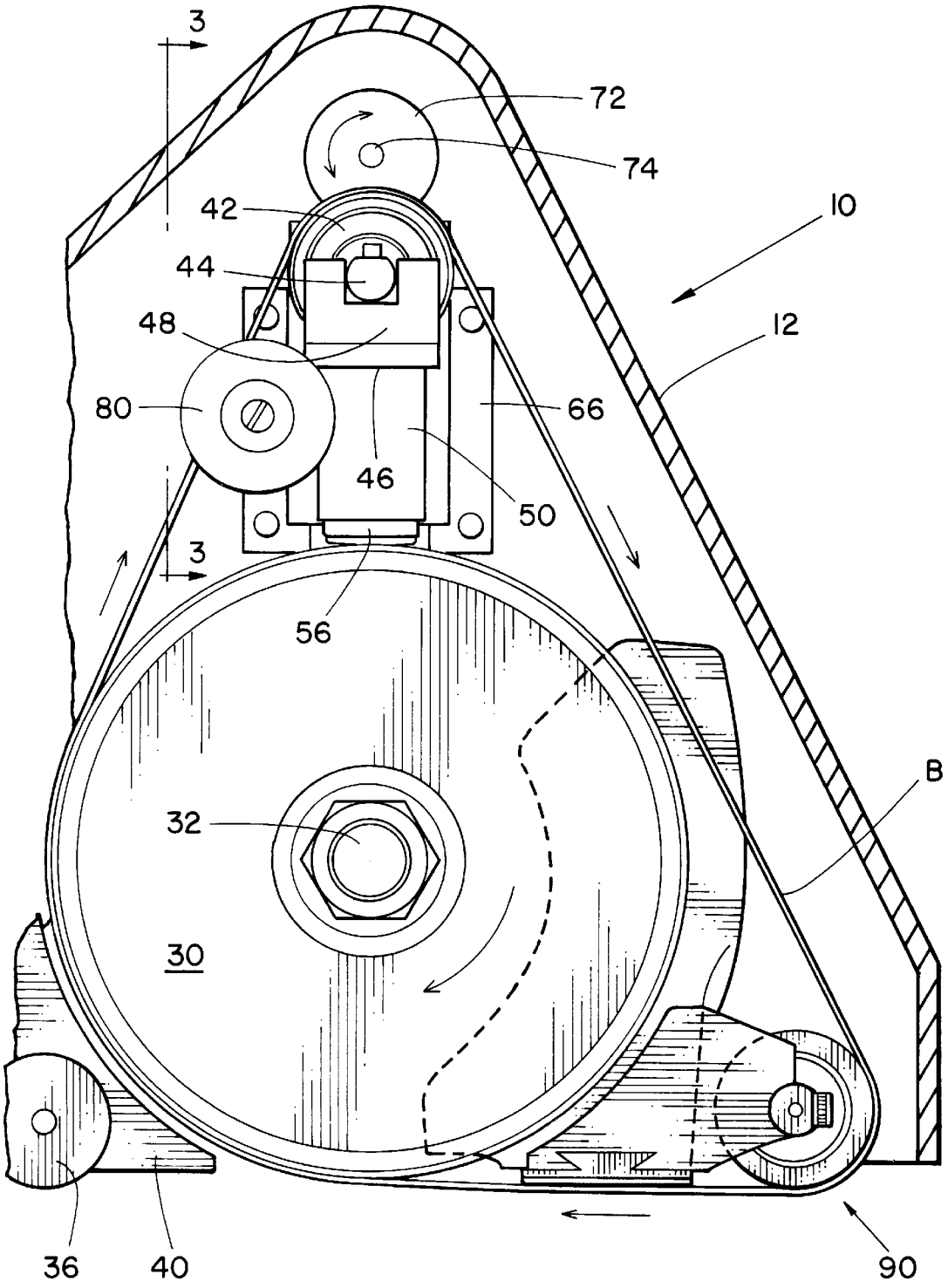
FIG. 2 is a section along the line 2—2 of FIG. 1.

Referring now to FIG. 2, it will be seen that the housing 12 contains a main drum or roll 30, defining a roll axis and mounted on a central axle 32. The axle 32 is rotatably mounted in suitable bearings (not shown), in a sleeve extending from one side wall of the housing.

The apparatus according to the invention incorporates a tension roller system, which is essentially the same as that shown in U.S. Pat. No. 5,341,605 issued Aug. 13, 1994, Inventor: James Tasikas.

The tension roller assembly shown in that patent at FIGS. 8 and 9 is incorporated in the present invention in substantially the same form. It is described again here simply for the sake of completeness and the earlier disclosure is deemed included in the present description by reference.

Figure 5:
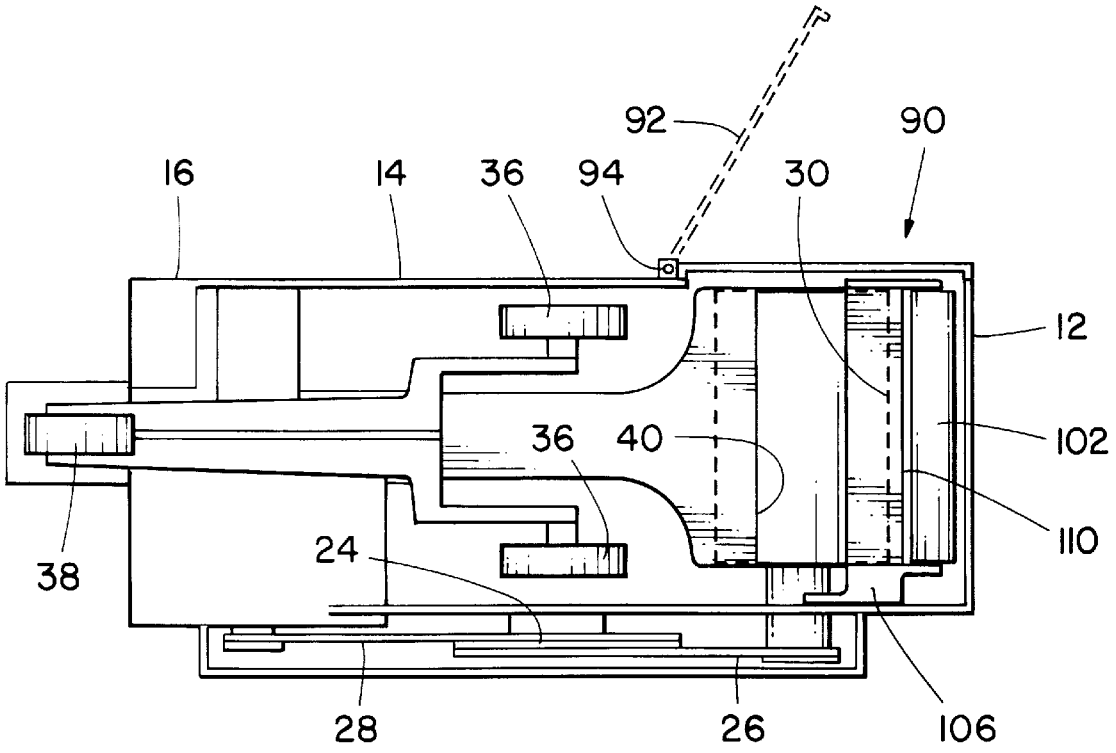
FIG. 5 is a lower plan view of the sander of FIG. 1.

In order to support the machine on the floor, two front wheels 36—36 (FIG. 5) are provided, beneath the motor housing 14. One of wheels 36 is adjustable in a manner well known in the art, to level the main roll. A third single guide wheel 38 is provided beneath the vacuum housing 16, adjacent the lower end of the handle 22. The guide wheel 38 is swingable for steering and is connected to the lower end of the handle 22. The operator can easily guide the machine and steer it, by rotating the rear wheel guide 38 about a vertical axis from side to side.

In addition, a dust catcher blade 40 is provided adjacent the main roll 30, connected by to the vacuum housing 16. In this way, as the roll 30 rotates, dust will be sucked up by the dust catcher, and collected in the bag 20.

A tension roller 42 an axle 44, is supported on a mounting bracket 46, by means of bearing mounts 48 at each end. Bolts pass through the free ends of axle 44, securing the axle 44 at its two free ends, to the mounts 48.

Intermediate the two ends of the bracket 46, a mounting column 50 extends downwardly. Column 50, is mounted at the free end of a cantilever arm 54. The opposite end of arm 52 is provided with an elongated cylindrical sliding body 54 extending upwardly therefrom, and extending downwardly therefrom, a spring retention boss 56.

Sliding body 54 is received in a cylindrical bearing sleeve 58, and is slidable upwardly and downwardly against the pressure of a spring 60.

Sleeve 55 is pivotally mounted, by two pivot bolts 62 (only one is shown) which in turn pass through arms 64. Arms 64 are secured to a mounting plate 66. Mounting plate 66 is bolted to the interior surface of the side wall of the housing 12, by any suitable bolts 68.

The sleeve 58 is swingable, through a relatively modest arc, on pivot bolts 62. In order to procure adjustable swinging movement of the sleeve 58, an adjustment bolt 70, is provided. Bolt 70 passes through a threaded bore in plate 66, and engages the lower end of the sleeve 58. Bolt 70 extends through the housing, so that it is accessible from the exterior of the machine. Rotation of the bolt 70 in one direction will cause the lower end of the sleeve 58 to swing outwardly away from the plate 66, and rotation of the screw in the reverse direction will permit it to swing back again.

This will in turn cause tilting movement of the arm 52, and thereby cause corresponding tilting movement of the tension roller 42.

Figure 3:
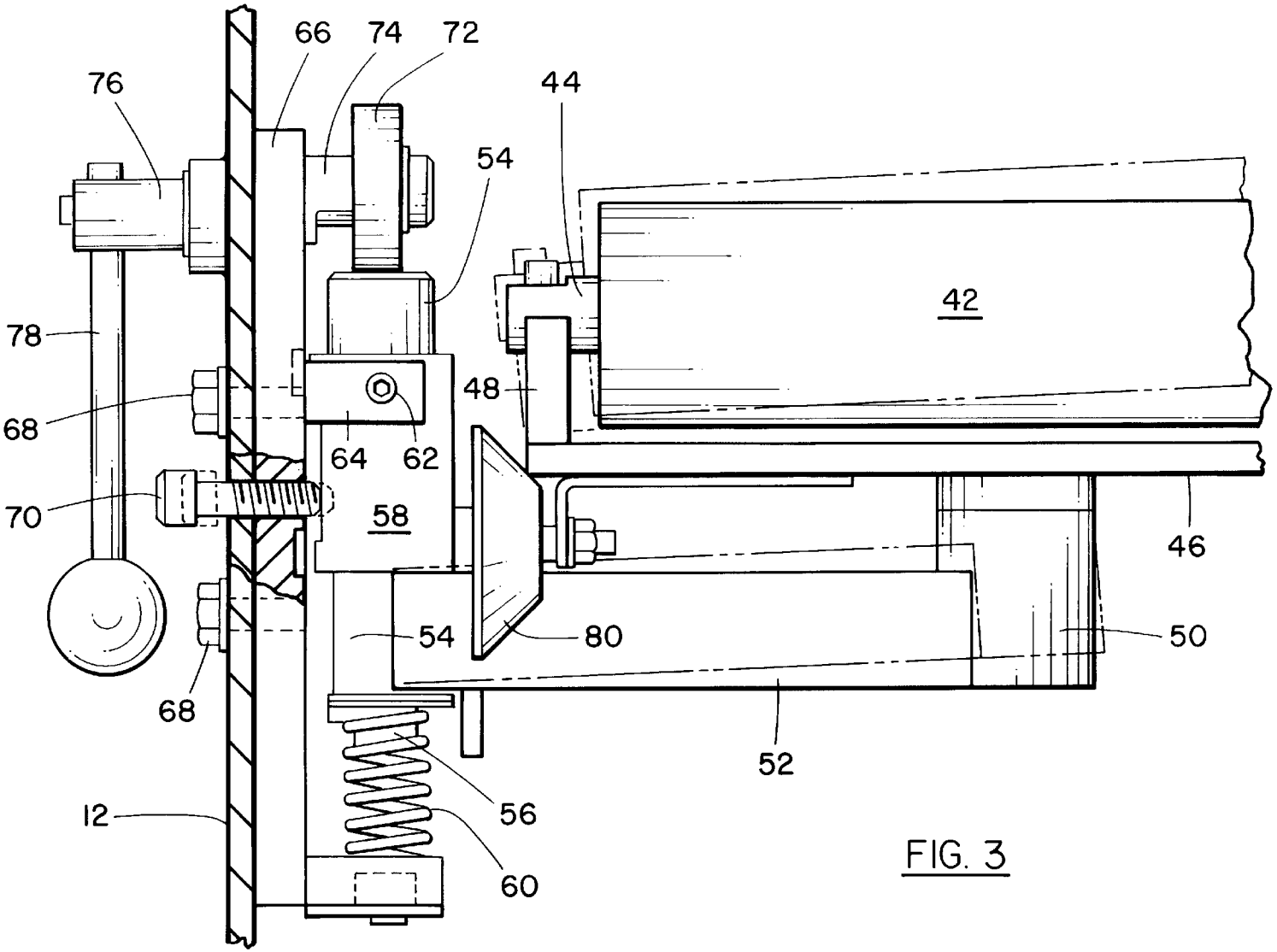
FIG. 3 is a section along the line 3—3 of FIG. 2.

Any angular adjustment can be readily made to the tilt angle of the roller 42, ie. tilting its axis relative to the main drum 30 by operating the bolt 70 from the exterior of the machine (shown in phantom in FIG. 3). This may be required to accommodate variations in the length of the belt, or minor variations in the length of the belt from one side to the other.

In order to fit on a new belt or to remove a used belt, the tension roller 42 can be moved towards and away from the main roll 30, the cylindrical body 54 is slidable within the sleeve 58 against the pressure of the spring 60.

This sliding movement is achieved by means of the roller cam 72 mounted on crank pin 74. Crank pin 74 is in turn mounted on rotatable rod 76. An operating arm 78 passes through the free end of the rod 76 on the exterior of the machine, so as to permit an operator to rotate rod 76, thereby forcing the cam 72 against the top of the cylindrical body 54 and forcing the cylindrical body 54 downwardly against the spring 60.

As the belt passes around the tension roller 42, it is centred by guide pulleys 80 provided, at opposite ends of the bracket 46, which maintain the belt centred on the roller 42, and main roll 30.

Figure 4:
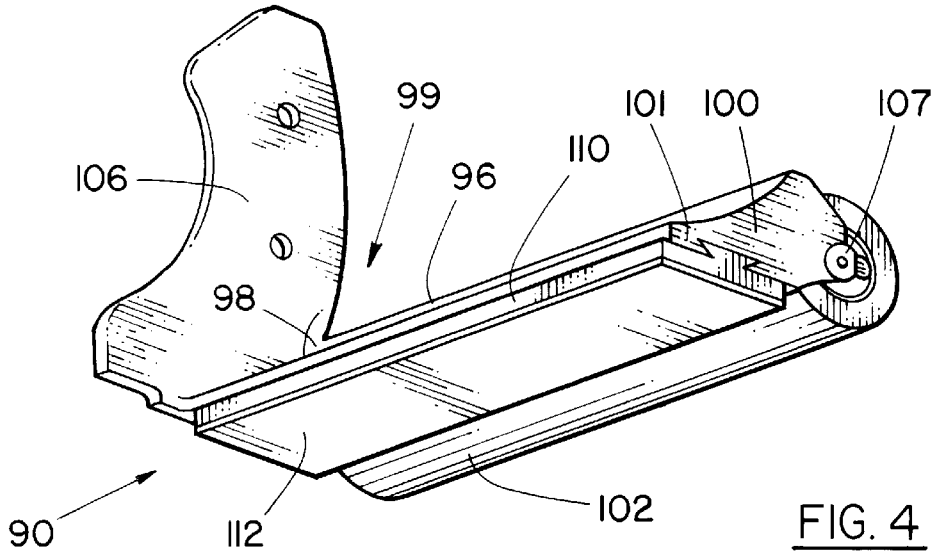
FIG. 4 is an enlarged perspective of the extension roll.

In accordance with a particularly useful feature of the present invention, the sanding belt B is extended around a third extension roll assembly indicated generally as 90, (FIGS. 2 and 4).

The extension roll assembly 90 functions to cause the belt B to run around a generally triangular path, with the portion of the belt extending between the extension roll assembly 90 and the main roll 30, being generally planar and level with the surface to be sanded. The purpose of this is to provide a contact area of the sanding belt, on the working surface, which is essentially rectangular in configuration, so as to avoid the disadvantages of prior art belt sanders, and drum sanders, in which the contact with the work surface was essentially a line or tangent.

At the same time, it is necessary to leave the one end of the main roll 30, the tension roll 42 and the extension roll assembly 90 unobstructed to one side of the apparatus so that sanding belts B can be removed and replaced from the side (i.e. at the free ends of the rolls).

The ability to easily remove the belt B from one side is especially important in a large, floor-operating sander because the weight of the sander does not allow the unit to be easily picked up and manipulated. Further, the ability to easily remove the belt B without removing any other parts makes it easier for any person to operate the sander.

For this purpose, the housing 12 defines a side access door 92, mounted on hinges 94 and swingable outwardly and, in fact, being capable of being completely removed from the hinges for simplicity.

The extension roll assembly 90 comprises a transverse mounting arm or support plate 96, having two side frame members 98 and 100.

The side frame member 98 is attached to a mounting end 99 of the support plate 96 and the side frame member 100 is attached to a free end 101 of the support plate 96. The two side frame members 98–100 support between them an extension roll 102, having an axle 104 extending there through and supported in the side frames 98–100.

A mounting frame or attachment plate 106 is connected to the plate 96 at the mounting end 99 thereof such that the support plate 96 is supported in a cantilever fashion. The attachment plate 106 and is, in fact, formed integrally therewith and is bolted to the inside of the housing 12.

The extension roll 102 is a free running roll and simply provides a means for guiding the sanding belt B along a generally linear path away from the main roll 30. The sanding belt B extends freely between the extension roll 102 and the tension roll 42 at the front of the apparatus so as to be free of contact with the main roll 30 in this region.

In order to control the portion of the belt B extending between the extension roll 102 and the main roll 30, a control bar 110 is attached to the plate 96, and is adapted to contact and engage on its underside, the inside surface of the sanding belt B between the main roll 30 and the extension roll 102.

Preferably, there will be an anti-friction pad 112 secured to the underside of the control bar 110. The belt will pass over the anti-friction pad and there will be a minimum friction between the pad and the belt. The anti-friction pad 112 is formed of a type of thermo plastic material which reduces friction, and thus prevents the build up of heat between the belt and the control bar 110. It will be appreciated that in this region the function of the control bar 110 and anti-friction pad 112 is to hold that area of the belt B substantially planar, so as to bring it into contact with a substantial area, typically a rectangular area, on a work piece. This then produces the desired smooth even sanding finish on the work piece.

While in this embodiment, the invention has been described in association with a main drum, a tension roll assembly, and extension roll assembly, providing a essentially triangular belt drive path, it will be appreciated that in some circumstances, it may be possible to combine the function of tension roller assembly and the extension roll assembly in a single assembly so that the extension roll is moveable somewhat in the manner of the tension roll assembly and thus provides both functions. In this case, the belt drive path would essentially be more or less oval, with linear belt paths extending between two rolls rather than three. It is believed that this modification is self evident, and it is deemed to be within the scope of the invention to make such modifications.

In operation, as the main drum rotates in a clockwise direction (FIG. 2), it will drive the sanding belt B around the tension roller 42 and then around the extension roll 102, and underneath the anti-friction pad 112. This will then cause contact between the sanding belt B and the working surface, on this example a hardwood floor, over a substantial generally planar rectangular surface area of the sanding belt, and thereby avoiding the disadvantages associated with the line or tangent contact engagement, experienced with prior art belt sanders.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A belt sander for sanding a workpiece with a sanding belt and comprising:

housing means;

a main roll mounted in said housing means, said main roll defining a roll axis;

power operated means for rotating said main roll;

a tension roller, around which the sanding belt can be placed, movably mounted on said housing means in a cantilever fashion and relative to said main roll;

biassing means operable to urge said tension roller away from said main roll, whereby to apply tension to the sanding belt placed there around; and an extension roll assembly, said extension roll assembly including;

a mounting frame, said mounting frame secured to said housing means relative to said main roll;

a mounting arm means having a mounting end and a free end, said mounting end mounted to said mounting frame and said mounting arm means extending from said mounting frame in cantilever fashion;

bearings mounted on said mounting arm means in spaced relation;

an extension roll mounted on said bearing on said mounting arm means whereby said extension roll is located adjacent to the main roll for extending the sanding belt from said main roll substantially parallel to a plane of the work piece and whereby said extension roll extends in a cantilever fashion along an axis substantially parallel to said roll axis of said main roll;

a belt control bar extending between said mounting end and said free end of said mounting arm means and located between the extension roll and the main roll for controlling the sanding belt and defining a planar work area for the sanding belt; and a friction reducing means provided to said belt control bar, whereby said free end of said mounting arm means is free for installation or removal of the sanding belt onto or from said extension roll and said main roll.

2. A belt sander as claimed in claim 1 further comprising tension means operable to tension the sanding belt placed around the main roll and extension roll, and access means in said housing means for giving access to said main drum and said extension roll.

3. A belt sander as claimed in claim 1, in which the control bar extends downwardly slightly relative to a tangent between the main roll and the extension roll.

4. A belt sander as claimed in claim 1, said friction reducing means comprising an anti-friction plastic material.

5. A belt sander as claimed in claim 1 and including pressure means operable on said tension roller, whereby to force said tension roller against said biassing means towards said main roll, thereby permitting removal and replacement of said sanding belt thereon.

6. A belt sander as claimed in claim 5 and including rotatable belt guide members adjacent opposite ends of said tension roller, whereby to guide said sanding belt passing over said tension roller.

7. A belt sander as claimed in claim 6 and including pivotal means mounting said tension roller to said housing, such that said tensional roller is both slidable towards and away from said main roll, and is further swingable relative thereto, whereby to procure tilting of said tension roller relative to said main roll.

* * * * *